United States Patent [19]

Macfie

[11] 4,398,692

[45] Aug. 16, 1983

[54] UTILITY DEVICE FOR SUSPENDING SHEET-LIKE MATERIAL

[76] Inventor: James P. Macfie, 115 Lausanne Dr., Camden, S.C. 29020

[21] Appl. No.: 326,670

[22] Filed: Dec. 2, 1981

[51] Int. Cl.[3] ..... A47F 5/00

[52] U.S. Cl. ..... 248/309 R; 211/45; 211/89

[58] Field of Search ..... 248/316 F, 359, 360, 248/309 R; 211/89, 45, 46, 47, 48; 160/330; 16/87.2, 87.4 R, 87.4 W; 24/255 SL; 223/DIG. 1

[56] References Cited

U.S. PATENT DOCUMENTS

| | | | |
|---|---|---|---|
| 3,161,929 | 12/1964 | Swett | 16/87.2 UX |
| 3,660,861 | 5/1972 | Delmonico | 248/360 X |
| 3,755,859 | 9/1973 | Solari | 248/359 X |
| 3,759,398 | 9/1973 | Romney | 211/47 X |
| 3,772,734 | 11/1973 | Kimel | 16/87.2 |

FOREIGN PATENT DOCUMENTS

| | | | |
|---|---|---|---|
| 1259053 | 1/1968 | Fed. Rep. of Germany | 16/87.2 |

*Primary Examiner*—J. Franklin Foss
*Attorney, Agent, or Firm*—Dority & Flint

[57] ABSTRACT

A utility fastener device for securing sheet material 10 to associated structure is disclosed as including a ring A closed by a snap closure in the form of a socket closure B and plug closure C between which the material is gripped. Socket closure B includes an interior opening 18 having a gripping rim D catching material pushed into the opening by plug C. The socket opening and plug have a smooth rounded configuration devoid of sharp edges to hold the material without puncturing or tearing.

5 Claims, 3 Drawing Figures

UTILITY DEVICE FOR SUSPENDING SHEET-LIKE MATERIAL

BACKGROUND OF THE INVENTION

Heretofore, sheet material such as toweling has been attached to associated structures by the use of a metal ring and grommet forming a hole in the towel. Such is used, for example, in attaching a golf bag towel to a golf bag and in other applications of athletic towels. A hook and reinforced hole arrangement is also used in suspending other sheet-like material such as shower curtains and room divider curtains. However, the problem occurs, especially in athletic towels, that the metal parts soon begin to rust and bleed on the toweling. With ring and hole-type attachments, even in the cases where reinforcement is utilized, the sheeting or toweling often tears around the hole.

Accordingly, an important object of the present invention is to provide a device for attaching or suspending sheet material without the need of forming a hole in the material.

Another important object of the present invention is to provide a device for attaching sheet-like material to an associated structure by which the material may be quickly attached and unattached by a simple snap motion.

Yet another important object of the present invention is to provide a utility device for attaching sheet material to an associated structure which avoids tearing or punching a hole in the material yet positively grips the material against slippage.

SUMMARY OF THE INVENTION

The above objectives are accomplished according to the present invention by providing a continuous flexible ring-like element whose free ends are closed by means of a socket and plug closure wherein the socket includes an inner rim member which grips the sheet-like material when pushed in the socket by means of the plug member snapped therein.

BRIEF DESCRIPTION OF THE DRAWINGS

The construction designed to carry out the invention will be hereinafter described, together with other features thereof.

The invention will be more readily understood from a reading of the following specification and by reference to the accompanying drawing(s) forming a part thereof, wherein an example of the invention is shown and wherein.

DESCRIPTION OF A PREFERRED EMBODIMENT

The invention relates to a device for fastening and attaching sheet-like material to an associated structure such as a hand towel attached to a golf bag or a kitchen door handle, or the like. The device includes a continuous ring-like element A. A socket closure means B is carried on one end of the element and a plug closure member C carried on the other end of the element which snap together to grip the sheet material therebetween while closing ring element A. A socket interior opening is defined by an exterior wall of the socket means in which material plug C is received. The plug and socket closure means are dimensioned so as to define a material containing space therebetween when fitted together. A rim means D carried by the socket within the open interior thereof extends into the interior of the socket, catching material in the material containing space and gripping the material when the closure means are fitted together. The socket interior opening and the plug closure have a smooth curved complimentary configuration devoid of any sharp intersecting edges as would tear or punch a hole in the sheet material held therein.

Figure 1:
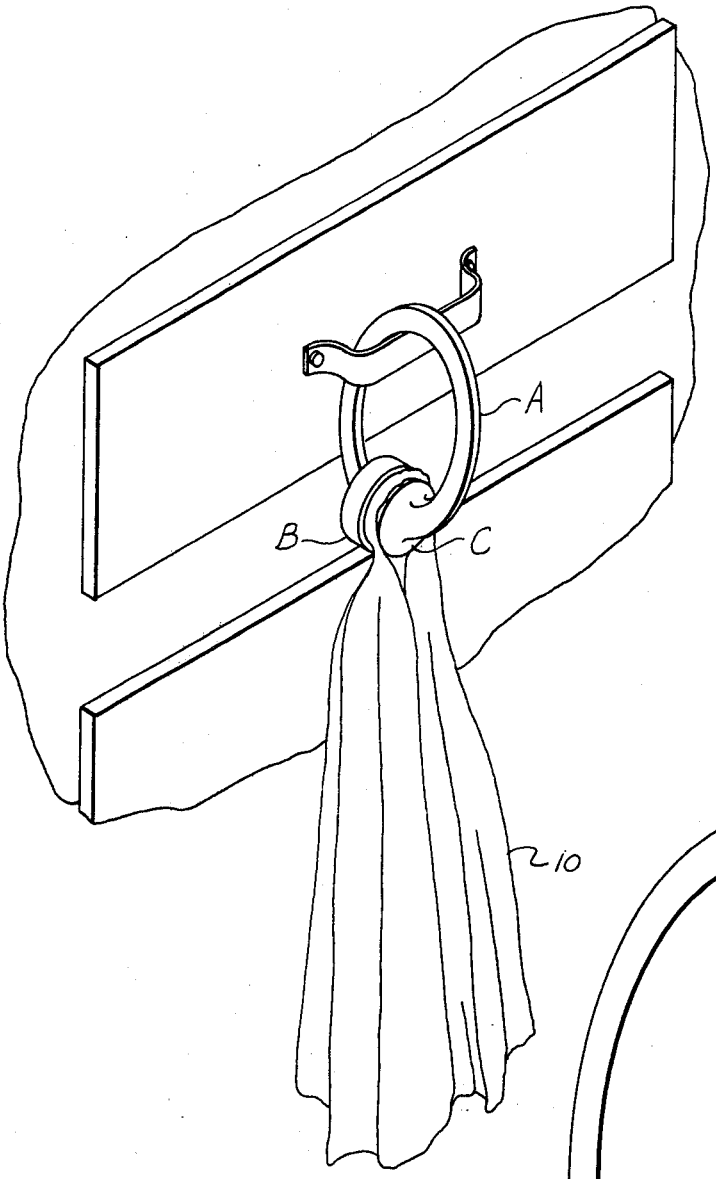
FIG. 1 is a perspective view illustrating a device constructed according to the present invention for holding a hand towel.
Figure 3:
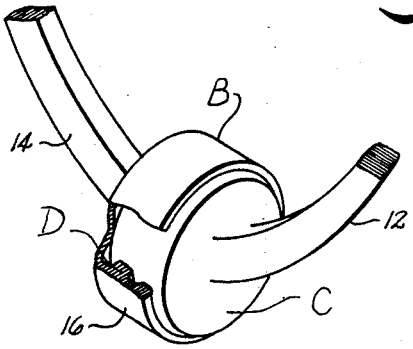
FIG. 3 is a perspective view with parts cut away illustrating a device constructed according to the present invention for attaching sheet-like material to associated structure.
Figure 2:
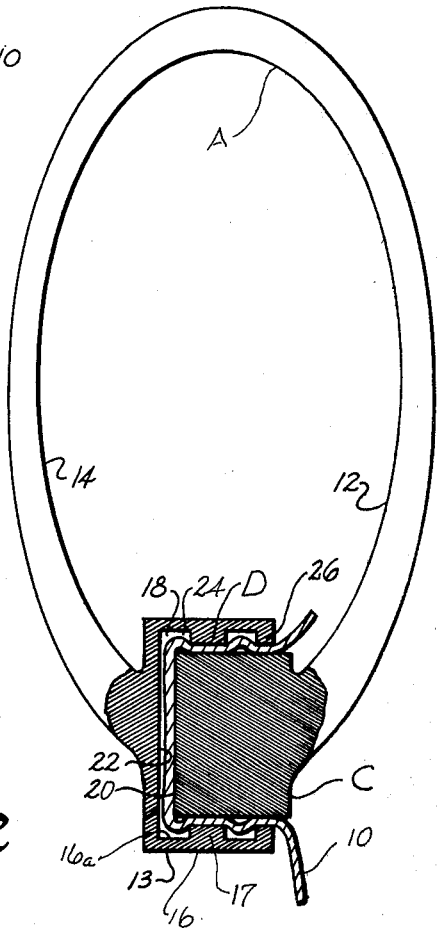
FIG. 2 is an elevation view with the closure of the device illustrated in section.

Referring now in more detail to the drawings, FIG. 1 illustrates ring-like element A in the form of an oval ring means encircling a handle of a kitchen drawer by which a hand towel 10 is held. The device, including the ring element A and closure members B and C, is preferably constructed as a one-piece molded device. The device includes a plastic or other suitable resilient material such that opposing ends 12 and 14 may be flexed and slightly pulled apart for the release of the sheet material and enabling the ring element to be placed over a handle or like member of an associated structure to which the sheet material is to be attached.

The socket means B is preferably rounded having an exterior wall 16 defining an interior opening 18 which is a smooth curved rounded opening having no sharp edges. The rim means D includes an interior rim 17 which encircles at least part, if not all, of the wall 16 and extends inwardly into the opening. The plug member C is a smooth curved rounded plug having a smooth planar face 20 by which the material 10 is pushed in socket B. The plug face presents an enlarged surface for pushing material into the socket opening 18 acting as a plug.

Plug means C is dimensioned with respect to the interior 18 to define a material containing space 24 between the rim D, planar face 22, and interior wall **16*a*** of the socket wherein the material may be gathered and contained when pushed into the socket interior by the plug closure C. It is preferred that the plug and interior opening be of a smooth rounded shape so as to avoid any tear or puncturing of the material. While illustrated as circular, any other ellipsoidal shape may be utilized or other rounded configuration devoid of any sharp intersecting edges.

While the ring element A is illustrated as being oval, other ring-like shapes such as rectangular or triangular may also be utilized as long as a closed element is provided whereby the ring is closed by the snap closure provided by members B and C.

Rim means may include a second, optional interior rim 26 carried in the opening 18 at its outermost edge catching sheet material 10 at the opening edge.

While a preferred embodiment of the invention has been described using specific terms, such description is for illustrative purposes only, and it is to be understood that changes and variations may be made without departing from the spirit or scope of the following claims.

What is claimed is:

1. A utility device for securing sheet-like material to an associated structure comprising:

a closed continuous ring-like element having a flexible ring means for encircling and attaching said device to an associated structure;

a socket closure means carried on a first end of said ring means having an interior opening defined by a socket exterior side wall and back wall;

a plug closure means carried on a second end of said ring means fitting within said socket closure means;

said ring means being constructed from a resilient material facilitating flexing of said ring means to an open position wherein said socket and plug closure means are pulled apart accommodating placement of said ring means over said associated structure;

said ring means flexing to a closed position in which said plug closure means is inserted in said socket closure means;

rim means extending about said socket opening periphery for catching said sheet-like material;

a material containing space defined by said peripheral side wall and back wall of said socket closure means, said rim means, and said plug closure means when inserted in said socket closure means in which said sheet-like material is gathered;

said plug closure means including a rounded plug body generally devoid of sharp edges having an enlarged blunt surface for pushing and packing said material into said material containing space beyond said rim means; and said flexible ring means urging said plug and socket closure members together in said closed position and said gathered material being gripped between said rim means and plug body thereby securing said material, socket closure means, and plug closure means together.

2. The apparatus of claim 1 wherein said socket and plug means are circular in section.

3. The apparatus of claim 1 wherein said ring-like element is curved.

4. The apparatus of claim 1 wherein said device is molded as a one-piece structure of plastic material.

5. The apparatus of claim 1 wherein said rim means includes a rim projection extending around the entire periphery of said socket opening.

* * * * *